US006976329B1

(12) United States Patent
Foster

(10) Patent No.: US 6,976,329 B1
(45) Date of Patent: Dec. 20, 2005

(54) ILLUMINATED SIGN UNIT

(76) Inventor: Jeffrey J. Foster, 1676 Waterford Rd., Walworth, NY (US) 14568

( * ) Notice: Subject to any disclaimer, the term of this patent is extended or adjusted under 35 U.S.C. 154(b) by 0 days.

(21) Appl. No.: 10/905,892

(22) Filed: Jan. 25, 2005

(51) Int. Cl.[7] ..... G09F 13/04
(52) U.S. Cl. ..... 40/572; 40/575; 40/611.06; 362/812
(58) Field of Search ..... 40/541, 564, 572, 40/575, 607.01, 607.05, 607.09, 611.06; 362/812, 183

(56) References Cited

U.S. PATENT DOCUMENTS 892,615 A 7/1908 Perry
1,348,957 A 8/1920 Pope
1,810,264 A 6/1931 Bonitz
2,882,631 A 4/1959 Boone
3,251,985 A 5/1966 Krupnick
4,021,947 A 5/1977 Shneider
D281,336 S 11/1985 Ahlgren
4,623,073 A * 11/1986 Hansen ..... 221/45
4,718,185 A * 1/1988 Conlin et al. ..... 40/442
4,878,303 A 11/1989 Banniza et al.
4,934,079 A 6/1990 Hoshi
5,083,390 A 1/1992 Edman
5,309,656 A * 5/1994 Montgomery ..... 40/442
6,263,601 B1 * 7/2001 Emert ..... 40/564

* cited by examiner

*Primary Examiner*—Brian K. Green
(74) *Attorney, Agent, or Firm*—Donald R. Schoonover

(57) ABSTRACT

A sign unit includes a translucent holder unit which has a solar-powered lighting unit supported thereon. A container is mounted on one side of the holder unit and is adapted to contain printed information. Anchor stakes support the holder unit.

2 Claims, 1 Drawing Sheet

ILLUMINATED SIGN UNIT

BACKGROUND OF THE INVENTION

The present invention relates to the general art of card, picture or sign exhibiting, and to the particular field of illuminated signs.

Many people conduct yard sales and want to notify people passing by of the event, the times and dates, as well as provide information regarding items that may be on sale. Additionally, many small businesses like to advertise and notify people passing by their store of sales, and the like. Still further, many rental buildings wish to advertise rental properties.

However, the inventor is not aware of any sign suitable for providing such information for a small entity, such as an individual or a small business. Heretofore, such small entities have had to resort to hand-written signs and small posters to provide such information.

Therefore, there is a need for a sign that can be used by a small entity to provide information to potential customers regarding merchandise or services that may be provided by the small entity.

Still further, some of these signs may be in poorly lighted areas and thus may be difficult to see. This degraded visibility may vitiate any advantages associated with the sign.

Therefore, there is a need for a sign that can be used by a small entity to provide information and will be visible even in low light situations.

Still further, many small entities change their featured items or services on a periodic basis. For example, a restaurant may change its specials on a daily basis, or a store may offer different items on different days of the week. Each time an advertisement is changed, the signs must be changed. This is difficult and onerous if special signs must be printed up each time the advertisement is changed. In some cases, parts of a pre-printed sign are simply deleted and other parts added to the sign. This may degrade the appearance of the sign.

Therefore, there is a need for a sign that can be used by a small entity to provide information and which can be easily and quickly changed without degrading the presentation of the sign.

Some signs are simply taped to a window. After awhile, the tape may dry out or may leave marks on the support after the sign has been removed.

Therefore, there is a need for a sign that can be used by a small entity to provide information and which will not require tape or other such products to support the sign in place.

PRINCIPAL OBJECTS OF THE INVENTION

It is a main object of the present invention to provide a sign that can be used by a small entity to provide information to potential customers regarding merchandise or services that may be provided by the small entity.

It is another object of the present invention to provide a sign that can be used by a small entity to provide information and will be visible even in low light situations.

It is another object of the present invention to provide a sign that can be used by a small entity to provide information and which can be easily and quickly changed without degrading the presentation of the sign.

It is another object of the present invention to provide a sign that can be used by a small entity to provide information and which will not require tape or other such products to support the sign in place.

SUMMARY OF THE INVENTION

These, and other, objects are achieved by an illuminated sign unit that includes a translucent holder unit which will accommodate materials to be displayed and which has an open top end. A solar powered lighting unit fits on the open top unit to provide lighting to the interior of the holder unit. A storage container is mounted on one side of the holder unit and anchor stakes are fixed to the bottom end of the holder unit.

Using the illuminated sign unit embodying the present invention will permit a small entity, such as an individual, to display information in a highly visible manner and to quickly and easily change that information as needed. The sign unit can be securely mounted in the ground and thus will not require tape or other such adhesive materials.

BRIEF DESCRIPTION OF THE DRAWING FIGURES

DETAILED DESCRIPTION OF THE PREFERRED EMBODIMENT

Figure 2:
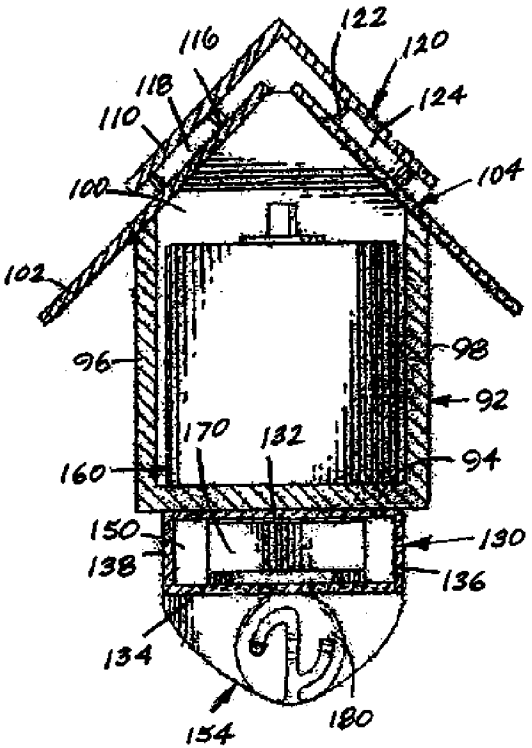
FIG. 2 is a view taken along line 2—2 of FIG. 1.

Other objects, features and advantages of the invention will become apparent from a consideration of the following detailed description and the accompanying drawings.

Referring to the Figures, it can be understood that the present invention is embodied in an illuminated sign unit 10 that achieves the above-stated objectives.

Unit 10 comprises a holder unit 12 in which display material is located. The display material can include advertisements, and the like, and can be changed as needed.

Holder unit 12 includes a first end wall 14 which is a bottom end wall when holder unit 12 is in use, a first side wall 16, a second side wall 18, and a transverse axis 20 which extends between first side wall 16 and second side wall 18.

A first translucent wall 30 is formed of translucent plastic or glass, or the like, and is mounted on first end wall 14 and on the first and second side walls 16, 18.

A second translucent wall 32 is mounted on first end wall 14 and on the first and second side walls 16, 18 and is spaced apart from first translucent wall 30 to define a gap 36 between the first and second translucent walls 30, 32 and between the first and second side walls 16, 18.

An open end 38 is a top end when holder unit 12 is in use.

Two anchor stakes 50 and 52 are fixedly attached to first end wall 14 and are used to support unit 12 in place. Anchor stakes 50, 52 are generally legs that are forced into the ground, but can be any suitable support element as will occur to those skilled in the art based on the teaching of this disclosure.

A container unit 60 is mounted on first side wall 16 and is used to contain literature that is associated with the goods or services being advertised by unit 10.

Container unit 60 includes a first wall 62 which is a rear wall and which is fixedly mounted on first end wall 16 when container unit 60 is in use, a first side wall 64 which is located adjacent to first translucent wall 30 when container unit 60 is in use, a second side wall 66 which is located adjacent to second translucent wall 32 when container unit 60 is in use, and an end wall 68 which is a bottom wall when container unit 60 is in use.

Container unit 60 further includes a translucent wall 70 which is fixed to the first and second side walls 64, 66 and to the end wall 68 of container unit 60 and which is spaced apart from first wall 62. A gap 72 is defined between the first and second side walls 64, 66 and the end wall 68 of container unit 60 and accommodates the literature stored in container unit 60.

A cover element 76 is pivotally mounted on first wall 62 to span gap 72 defined in the container unit 60. Cover element 76 is mounted on wall 62 by hinges, or the like, to move in direction 78 to open or close the container unit 60 as needed to dispense the material stored therein.

A lighting unit 90 is releasably supported on holder unit 12 adjacent to open end 36 of the holder unit 12 and provides light so any material displayed in holder unit 12 can be easily seen even in difficult lighting situations.

Lighting unit 90 includes a housing 92 having a first end 94 which is a bottom end when lighting unit 90 is in use, a first wall 96 mounted on first end 94, and a second wall 98 mounted on first end 94. Second wall 98 is spaced apart from first wall 96. A gap 100 is defined between the first and second walls 96, 98 of the housing 92.

Housing 92 further includes a first roof panel 102 mounted on first wall 96 and a second roof panel 104 mounted on second wall 98.

A first solar panel 110 is mounted on first roof panel 102 by mounting elements 116, and a vent gap 118 is defined between roof panel 102 and solar panel 110.

A second solar panel 120 is mounted on second roof panel 104 by mounting elements 122, and a vent gap 124 is defined between roof panel 104 and solar panel 120.

An enclosure unit 130 is mounted on first end 94 of housing 90 and includes a first wall 132 fixedly mounted on first end wall 94 of the housing 92, a second wall 134 spaced apart from first wall 132 of the enclosure unit 130, a first side wall 136, and a second side wall 138. Enclosure unit 130 further includes a first end wall 140 and a second end wall 142. A hollow interior volume 150 is defined by the first wall 132, the second wall 134, the first side wall 136 and the second end wall 142 of the enclosure unit 130.

Light fixture mounting flanges, such as light fixture mounting flange 154, are fixedly mounted on second wall 134 of the enclosure unit 130. The light fixture mounting flanges 154 are located in gap 36 defined between the first and second side walls 16, 18 of holder unit 12 when enclosure unit 130 is in use.

Figure 1:
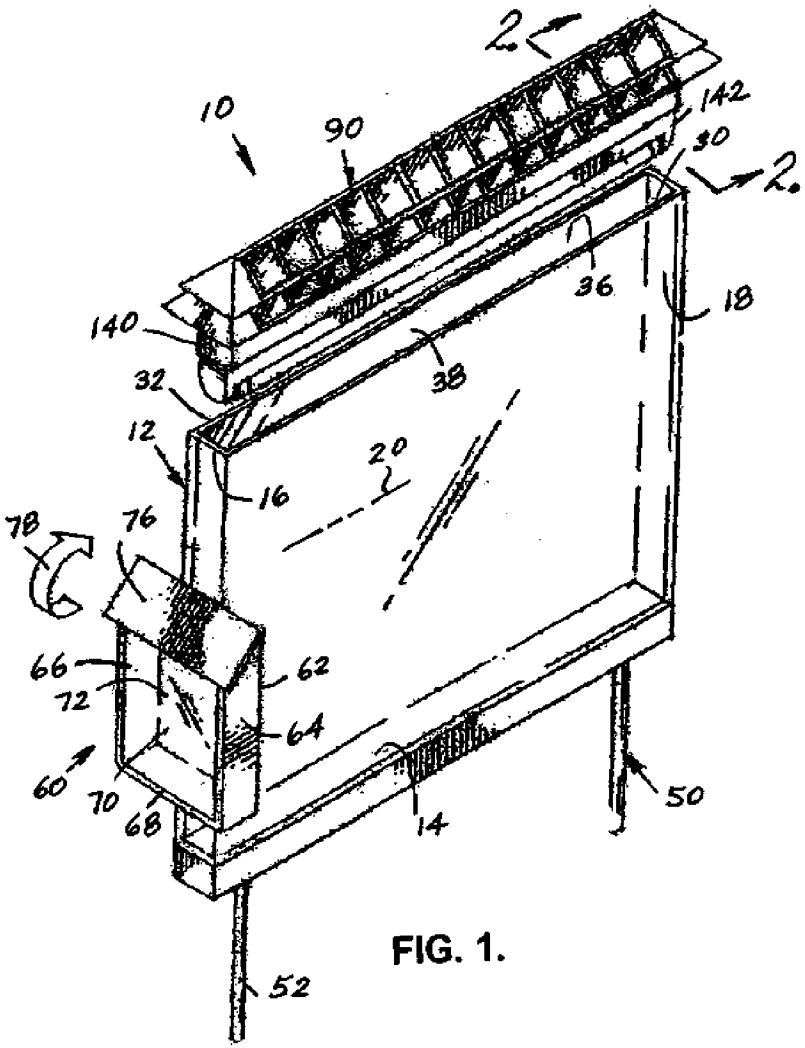
FIG. 1 is a perspective view of an illuminated sign unit embodying the present invention.

Lighting unit 90 is used by placing it on top of holder unit 12 as indicated in FIG. 1 so it is abuttingly supported on holder unit 12.

A rechargeable battery 160 is located in gap 100 and is electrically connected to the first and second solar panels 110, 120 in a manner known to those skilled in the art to be recharged by the solar panels 110, 120.

An electric converter 170 is located in hollow interior 150 defined in the enclosure unit 130 and is electrically connected to the rechargeable battery 160 to convert power from the battery 160 into power that can be used by lighting elements included with unit 10.

A light element 180 is mounted on the light fixture mounting flanges 154 and is electrically connected to electric converter 170 to be powered thereby. Light element 180 is located in gap 36 defined between the first and second side walls 16, 18 and the end wall 14 of the holder unit 12 when the enclosure unit 130 is in use.

Use of unit 10 can be understood from the teaching of the foregoing disclosure and thus will not be discussed in detail. Material, such as billboard-type material is inserted into holder unit 12 and brochures or like literature is inserted into container unit 60. Lighting unit 90 is then placed on top of holder unit 30 and activated, using an on/off switch, or the like. Power from battery 160 will activate light element 180 which is located and positioned to illuminate any material in holder unit 12. Battery 160 is recharged by a circuit which includes solar panels 110 and 120.

It is to be understood that while certain forms of the present invention have been illustrated and described herein, it is not to be limited to the specific forms or arrangements of parts described and shown.

What is claimed is:

1. An illuminated sign unit comprising:

(a) a holder unit which includes
  (1) a first end wall which is a bottom end wall when said holder unit is in use,
  (2) a first side wall,
  (3) a second side wall,
  (4) a transverse axis which extends between the first side wall and the second side wall,
  (5) a first translucent wall mounted on the first end wall and on the first and second side walls,
  (6) a second translucent wall mounted on the first end wall and on the first and second side walls and which is spaced apart from the first translucent wall to define a gap between the first and second translucent walls and between the first and second side walls, and
  (7) an open end which is a top end when said holder unit is in use;

(b) two anchor stakes fixedly attached to the first end wall of said holder unit;

(c) a container unit mounted on the first side wall and including
  (1) a first wall which is a rear wall and which is fixedly mounted on the first end wall of said holder unit when said container unit is in use,
  (2) a first side wall which is located adjacent to the first translucent wall of said holder unit when said container unit is in use,
  (3) a second side wall which is located adjacent to the second translucent wall of said holder unit when said container unit is in use,
  (4) an end wall which is a bottom wall when said container unit is in use,
  (5) a translucent wall which is fixed to the first and second side walls and to the end wall of said container unit and which is spaced apart from the first wall of said container unit, a gap being defined between the first and second side walls and the end wall of said container unit, and
  (6) a cover element pivotally mounted on the first wall of said container unit to span the gap defined in said container unit; and (d) a lighting unit which is releasably supported on said holder unit adjacent to the open end of said holder unit and which includes
  (1) a housing having
    (A) a first end which is a bottom end when said lighting unit is in use,
    (B) a first wall mounted on the first end of the housing, (C) a second wall mounted on the first end of the housing, the second wall being spaced apart from the first wall of the housing to define a gap between the first and second walls of the housing, (D) a first roof panel mounted on the first wall of the housing, (E) a second roof panel mounted on the second wall of the housing, (F) a first solar panel mounted on the first roof panel of the housing, (G) a second solar panel mounted on the second roof panel of the housing, (H) an enclosure unit mounted on the first end of the housing and which includes a first wall fixedly mounted on the first end of the housing, a second wall spaced apart from the first wall of the enclosure unit, a first side wall, a second side wall, a first end wall and a second end wall, a hollow interior volume being defined by the first wall, the second wall, the first side wall and the second end wall of the enclosure unit, and (I) a light fixture mounting flange fixedly mounted on the second wall of the enclosure unit, the light fixture mounting flange being located in a gap defined between the first and second side walls and the end wall of said holder unit when said enclosure unit is in use, (2) a rechargeable battery located in the gap between the first and second walls of the housing, and which is electrically connected to the first and second solar panels, (3) an electric converter located in the hollow interior volume defined in the enclosure unit and which is electrically connected to the rechargeable battery, and (4) a light element mounted on the light fixture mounting flange and which is electrically connected to the electric converter and which is located in the gap defined between the first and second side walls and the end wall of said holder unit when said enclosure unit is in use.

2. The illuminated sign unit as described in claim 1 further including mounting elements mounting the solar panels to the roof panels of said housing, and wherein the solar panels are spaced apart from the roof panels to define vents.

* * * * *